US010184208B2

(12) United States Patent
Rizzi et al.

(10) Patent No.: US 10,184,208 B2
(45) Date of Patent: Jan. 22, 2019

(54) LAUNDRY DRYING APPARATUS WITH HEATER UNIT HAVING ADJUSTABLE TEMPERATURE THRESHOLDS

(71) Applicant: Electrolux Appliances Aktiebolag, Stockholm (SE)

(72) Inventors: Marco Rizzi, Prata di Pordenone (IT); Terenzio Girotto, Sesto Al Reghena (IT)

(73) Assignee: Electrolux Appliances Aktiebolag (SE)

( * ) Notice: Subject to any disclaimer, the term of this patent is extended or adjusted under 35 U.S.C. 154(b) by 220 days.

(21) Appl. No.: 15/328,796

(22) PCT Filed: Jul. 7, 2015

(86) PCT No.: PCT/EP2015/065432

§ 371 (c)(1),
(2) Date: Jan. 24, 2017

(87) PCT Pub. No.: WO2016/012228

PCT Pub. Date: Jan. 28, 2016

(65) Prior Publication Data

US 2017/0211224 A1 Jul. 27, 2017

(30) Foreign Application Priority Data

Jul. 25, 2014 (EP) ..... 14178626

(51) Int. Cl.
*D06F 58/28* (2006.01)
*D06F 58/02* (2006.01)
*D06F 58/24* (2006.01)

(52) U.S. Cl.
CPC ..... *D06F 58/28* (2013.01); *D06F 58/02* (2013.01); *D06F 58/24* (2013.01);
(Continued)

(58) Field of Classification Search
CPC ..... D06F 58/28; D06F 58/02; D06F 58/24; D06F 2058/2829; D06F 2058/2854; D06F 2058/2893
(Continued)

(56) References Cited

U.S. PATENT DOCUMENTS 5,050,313 A 9/1991 Wakaeya et al.
5,345,694 A * 9/1994 Hayashi ..... D06F 58/28 34/550
(Continued)

FOREIGN PATENT DOCUMENTS

DE 19533241 A1 3/1997
EP 0978778 A1 2/2000
(Continued)

OTHER PUBLICATIONS

International Search Report issued in corresponding International Application No. PCT/EP2015/065432, dated Sep. 8, 2015.

*Primary Examiner* — Stephen M Gravini
(74) *Attorney, Agent, or Firm* — RatnerPrestia

(57) ABSTRACT

A laundry drying apparatus, in particular dryer or washing machine having drying function, has: a cabinet, a control unit (4) adapted to control a laundry drying cycle according to at least one drying program, a drum (18) rotatably arranged within the cabinet for receiving laundry to be dried, a drying air channel (20) adapted at least to guide drying air into the drum (18), and a heater unit (6) arranged at or in the drying air channel (20) and being adapted to heat the drying air. The heater unit (6) has two or more heating levels. A temperature sensor unit is adapted to detect the temperature of the drying air and to provide at least one temperature signal to the control unit (4). The control unit (4) is adapted to control the heater unit (6) to heat the drying air at a
(Continued)

selected one of the two or more heating levels. The control unit (4) is adapted to select or determine and apply during the drying cycle one of two or more temperature threshold sets, wherein the two or more temperature threshold sets are used by the control unit (4) for determining the heating level to be applied by the heater unit (6) in dependency of the at least one temperature signal from the temperature sensor unit. The control unit (4) is adapted to select or determine one of the two or more temperature threshold sets in dependency of one or more operating parameters of the apparatus, wherein the temperature thresholds of the temperature threshold sets are mutually different or are not identical. During execution of the laundry drying cycle the control unit (4) is adapted to select or determine one of the two or more temperature threshold sets in dependency of one or more of the following operation parameters:

a) the time or temporal progress of the laundry drying cycle,
b) one or more operation parameters of or for the heater unit (6),
c) an electrical or mechanical parameter of the drum (18) motor,
d) a temporal gradient of the drying air temperature during execution of the laundry drying cycle, and
e) an ambient temperature indicative for the temperature outside the apparatus cabinet or a temperature indicative of an apparatus component temperature.

19 Claims, 5 Drawing Sheets

(52) U.S. Cl.
CPC ..... *D06F 2058/2829* (2013.01); *D06F 2058/2854* (2013.01); *D06F 2058/2893* (2013.01)

(58) Field of Classification Search
USPC ..... 34/476, 595–610; 68/19, 20
See application file for complete search history.

(56) References Cited

U.S. PATENT DOCUMENTS

| | | | | | |
|---|---|---|---|---|---|
| 5,444,924 | A * | 8/1995 | Joslin | D06F 58/28 | 34/486 |
| 5,709,040 | A * | 1/1998 | Horwitz | D06F 58/22 | 34/565 |
| 7,669,350 | B2 * | 3/2010 | Yoo | D06F 58/28 | 34/403 |
| 7,900,374 | B2 * | 3/2011 | Bae | D06F 25/00 | 204/431 |
| 8,015,726 | B2 * | 9/2011 | Carow | D06F 58/28 | 34/381 |
| 8,112,902 | B2 * | 2/2012 | Muenzner | D06F 58/28 | 165/10 |
| 8,156,660 | B2 * | 4/2012 | Carow | D06F 58/26 | 200/16 R |
| 8,387,272 | B2 * | 3/2013 | Kim | D06F 58/28 | 165/166 |
| 8,387,274 | B2 * | 3/2013 | Ashrafzadeh | D06F 58/04 | 34/528 |
| 8,561,320 | B2 * | 10/2013 | Geer | F26B 25/22 | 134/172 |
| 9,206,543 | B2 * | 12/2015 | Morin | D06F 58/28 | |
| 9,297,493 | B2 * | 3/2016 | Bison | D06F 58/06 | |
| 9,371,609 | B2 * | 6/2016 | Anderson | D06F 58/28 | |
| 9,567,704 | B2 * | 2/2017 | Ros | D06F 58/22 | |
| 9,574,298 | B2 * | 2/2017 | Sartor | D06F 58/22 | |
| 9,677,218 | B2 * | 6/2017 | Ros | D06F 58/28 | |
| 9,777,423 | B2 * | 10/2017 | Stabon | D06F 39/02 | |
| 9,845,567 | B2 * | 12/2017 | Contarini | D06F 58/24 | |
| 2017/0211224 | A1 * | 7/2017 | Rizzi | D06F 58/28 | |

FOREIGN PATENT DOCUMENTS

| | | | | |
|---|---|---|---|---|
| EP | 2107151 | A1 | 10/2009 | |
| EP | 2516719 | A2 | 10/2012 | |
| EP | 2653603 | A1 | 10/2013 | |
| EP | 2977503 | A1 * | 1/2016 | D06F 58/28 |
| WO | WO 2016012228 | A1 * | 1/2016 | D06F 58/28 |

* cited by examiner

LAUNDRY DRYING APPARATUS WITH HEATER UNIT HAVING ADJUSTABLE TEMPERATURE THRESHOLDS

FIELD

The invention relates to a laundry drying apparatus, in particular a dryer or a washing machine having drying function.

BACKGROUND

EP 2 516 719 B1 discloses a laundry dryer and a method for controlling a drying cycle in such a laundry dryer. The temperature of process air circulating within the dryer is controlled as a function of a parameter indicating the degree of humidity of the laundry placed in a drum of the dryer, wherein the process air temperature is reduced as laundry humidity decreases.

SUMMARY OF SELECTED INVENTIVE ASPECTS

It is an object of the invention to provide an improved laundry drying apparatus and method.

A laundry drying apparatus is provided, in particular a dryer or a washing machine having drying function. The drying apparatus comprises a cabinet or housing, a control unit adapted to control a laundry drying cycle according to at least one drying program, a drum rotatably arranged within the cabinet for receiving laundry to be dried and a drying air channel adapted at least to guide drying air or process air into the drum. For example the drum may comprise a horizontal rotation axis (horizontal axis drum) or an inclined rotation axis (inclined axis drum), e.g. an axis inclination with respect to horizontal of 1 to 45°.

A heater unit is arranged at or in the drying air channel and is adapted to heat the drying air, wherein the heater unit comprises two or more heating levels. The control unit is adapted to control the heater unit to heat the drying air at a selected one of the two or more heating levels. For example the heating levels may include 0 (e.g. heater unit switched-off) and a first heating power level. Preferably three heating levels are provided: 0-level, first level and second level, wherein the first and second heating levels are preferably mutually different (i.e. not identical) and are not 0 (non-zero). The apparatus further comprises a temperature sensor unit which is adapted to detect the temperature of the drying air and to provide at least one temperature signal to the control unit. So it can be said that the control unit receives the at least one temperature signal from the temperature sensor unit to control the heater unit, wherein in turn for this control operation the control unit uses the selected or determined one of the two or more temperature threshold sets. Therein preferably the at least one temperature signal from the temperature sensor is compared to the temperature threshold values of the respectively or currently determined or selected temperature threshold set.

The control unit is adapted to select or determine and apply during the drying cycle one of two or more temperature threshold sets, wherein the two or more temperature threshold sets are used by the control unit for determining the heating level to be applied by the heater unit in dependency of the at least one temperature signal from the temperature sensor unit.

The control unit is adapted to select or determine one of the two or more temperature threshold sets in dependency of one or more operating parameters of the apparatus, wherein the temperature thresholds of the temperature threshold sets are mutually different or are not identical. The 'condition' that temperature thresholds of the temperature threshold sets are mutually different or are not identical includes the situation where in a first and second threshold set the upper (or lower) threshold value is the same but at least the lower (or upper) thresholds have different values. For example, in case each temperature threshold set comprises two thresholds, the threshold sets are not identical, wherein (i) one threshold of a first set may be the same as one threshold of a second set, or alternatively (i) both thresholds of the first and second set are different During execution of the (selected) laundry drying cycle the control unit is adapted to select or determine one of the two or more temperature threshold sets in dependency of one or more of the following operation parameters:

a) the time or temporal progress of the laundry drying cycle, for example since start of the drying cycle or since execution of a pre-routine executed before starting the intrinsic (selected) drying cycle,
b) one or more operation parameters of or for the heater unit, for example the number or times the heater unit (or at least one heating element of the heater unit) is switched OFF or ON, or the time elapsed between the heater unit (or at least one heating element) being switched ON (OFF) and subsequently being switched OFF (ON),
c) an electrical parameter and additionally or alternatively a mechanical parameter of the drum motor, e.g. current, voltage, power or phase supplied to the motor or torque supplied by the motor,
d) a temporal gradient of the drying air temperature during execution of the laundry drying cycle, which may be preferably determined using the one or more signals of the temperature sensor unit, and
e) an ambient temperature indicative for the temperature outside the apparatus cabinet or a temperature indicative of an apparatus component temperature, wherein in particular an apparatus component temperature may be different to drying air temperature.

The wording 'in dependency of' may include that if one or more or a combination of the above mentioned operation parameters reaches, exceeds or falls below a threshold for that/these or the combination of parameters. In general, the 'or more parameters' may mean a combination or any sub-combination of the listed parameters, e.g. combined in a mathematical formula having two or more or a plurality of variables (the operation parameters) or a look-up table using the two or more operation parameters.

Generally the control implemented by the control unit may be denoted as hysteresis-control(ler) using the selected or determined one of the temperature threshold sets.

Preferably the one or more operation parameters of the heater unit cited under b) include one or more of:

(i) The number of times (n_OFF) the control unit reduces the heating level of the heater unit or the number of times the control unit increases the heating level of the heater unit (n_ON). Alternatively the number of periods in which the control unit controls a reduction and increase of the heating level of the heater unit. Generally the terms 'switching OFF' and 'switching ON' includes the meaning of reducing to the next lower heating power level (OFF) and/or increasing to the next higher heating power level (ON) and vice versa.
(ii) The time or duration of a period ($t_{ON_OFF}$) in which the control unit increases the heating level of the heater unit to the subsequent reduction of the heating level. E.g. the period between switching ON and switching OFF at least one heating element of the heater unit.

(iii) The time or duration of a period ($t_{OFF_ON}$) in which the control unit decreases the heating level of the heater unit to the subsequent increase of the heating level. E.g. the period between switching OFF the heater unit and switching ON the heater unit.

(iv) The time or duration of a period in which the control unit controls a reduction and the subsequent increase of the heating level of the heater unit. The period in which the control unit controls a reduction and an increase of the heating level of the heater unit is the time period between switching ON the heater and the next time-point of switching ON the heater or alternatively the time period between switching OFF the heater and the next time-point of switching OFF the heater.

(v) The heating energy supplied to the heater unit during a period in which the control unit controls a reduction and the subsequent increase of the heating level of the heater unit.

(vi) The power supplied to the heater unit averaged over predetermined time periods.

An abnormal situation or state of the heater unit may be detected if the heater unit is longer than a predetermined persistence time in the OFF state or in the ON state or at a fixed intermediate heating level without change.

Preferably, the electrical or mechanical parameter of the drum motor mentioned under c) is one or more of the motor current, the phase voltage, the consumed motor power, the phase of the voltage applied to the motor and the torque generated by the motor.

The heater unit may comprise at least three heating levels which comprise a non-heating (zero) level, a first heating level and a second heating level. The heating power at the first and second heating level is above 0 W, wherein the heating power of the second heating level is higher than the heating power of the first heating level. Alternatively or additionally the heater unit is an electrical resistivity heater unit which may comprise at least two resistivity heater elements. In this case a first heating level with a first heating power is provided by powering a first one of the resistivity heater elements and a second heating level with a second heating power is provided by powering a second one of the resistivity heater elements and/or the first and second resistivity heater elements. As an example for a multi-level heater unit, the heater unit may comprise two heater elements R1, R2 having different heating power, such that four heating levels may be achieved, namely 0 (zero=both heater elements switched-off), R1, R2, R1+R2.

In an embodiment when the heater unit has three or more heating levels (including zero), the switching ON or to a higher level includes switching to any one of the levels higher than the currently used level and/or the switching OFF or to a lower level includes switching to any of the levels lower than the currently used level. With exemplary levels R1<R2<R3 the switching ON may be R1 to R2, R3 or R2+R3; R2 to R3 or R2+R3 and R3 to R2+R3, and the switching OFF may be R2 to R1, R3 to R1 or R2 and R2+R3 to R1, R2 or R3.

The laundry drying apparatus may be a condensate-type drying apparatus having a closed drying air loop comprising the drying air channel and the drum as a portion of the drying air loop, wherein a condensation unit is arranged in the drying air channel upstream the heater unit to dehumidify the process air before it is heated and supplied back to the laundry drum.

Preferably, the temperature sensor unit comprises at least one temperature sensor arranged to detect the drying air temperature at one or more of the following positions: downstream the heater unit and upstream the drum air inlet, downstream the drum air outlet, within a tub surrounding the drum and/or at the drum. For example a position at the drum is a surface forming a containment surface to the inner space of the drum. When for example the drying apparatus is a washer dryer which has a tub surrounding the drum, three temperature sensors may be provided a) at the drum inlet or upstream the drum, b) at the drum outlet or downstream the drum e.g. downstream the drum and upstream the condenser and c) in the tub, in particular in a space between the drum outer wall and the tub. For example the temperature sensor may be arranged at the fluid or washing liquid heater unit arranged in the tub (e.g. in the tub sump).

Apart from above preferred embodiments, the first temperature sensor may be positioned at any place along the drying air channel or drying air loop (e.g. inlet or outlet of the drum). A temperature sensor may even be positioned within or at a drum laundry receiving space. The drum air inlet may be provided at a drum mantle and/or at a drum rear wall. In particular, the drum rear wall may be integral part of drum, such that the rear wall rotates during drum rotation. Alternatively a stationary drum rear wall may be provided, such that the drum rear wall is fixed (or stationary during drum rotation). Preferably, the temperature sensor unit provides a combined temperature signal for judging the exceeding or falling below a temperature threshold. For example a combination of the drum inlet and outlet temperature, in particular the difference between inlet and outlet temperature.

Preferably, the control unit determining or selecting the one of the two or more temperature threshold sets in dependency of one or more operating parameters of the apparatus comprises that a storing element of the control unit stores at least two different predetermined temperature threshold sets and the control unit is adapted to select one of these predetermined temperature threshold sets in dependency of the one or more operating parameters. Alternatively the control unit determining or selecting the one of the two or more temperature threshold sets in dependency of one or more operating parameters of the apparatus comprises that a storing element of the control unit stores at least three different predetermined temperature thresholds and, in dependency of the one or more operating parameters, the control unit is adapted to select one of these predetermined temperature thresholds as the first lower temperature threshold and one as the second higher temperature threshold. According to a further alternative the control unit determining or selecting the one of the two or more temperature threshold sets in dependency of one or more operating parameters of the apparatus comprises that the control unit is adapted to determine one of the two or more temperature threshold sets by calculating at least one of the temperature thresholds for the next predetermined temperature threshold set to be applied on the basis of the one or more operating parameters.

Each one of the temperature threshold sets may comprise (i) a first higher temperature threshold used by the control unit for determining a drying air temperature state at which the heating power of the heater unit has to be set to a lower heating power, and (ii) a second lower temperature threshold used by the control unit for determining a drying air temperature state at which the heating power of the heater unit has to be set to a higher heating power. A temperature threshold set may comprise more than two thresholds, e.g. a third highest threshold at a high temperature at which a multi-level (three or more levels) heater unit is switched off or set to a very low heating power level; and additionally or alternatively a fourth lowest threshold at a lowest temperature at which the multi-level heater unit is set to the highest heating power.

According to a preferred embodiment, the control unit is adapted to select the one of the two or more temperature threshold sets independent of a detected laundry humidity or a current state of the laundry during execution of the laundry drying cycle.

In addition or alternatively the invention may provide the following apparatus and method:

Laundry drying apparatus, in particular dryer or washing machine having drying function, comprising:

a cabinet, a control unit adapted to control a laundry drying cycle according to at least one drying program, a drum rotatable arranged within the cabinet for receiving laundry to be dried, a drying air channel adapted at least to guide drying air into the drum, and a heater unit arranged at or in the drying air channel and being adapted to heat the drying air, wherein the heater unit has two or more heating levels, and a temperature sensor unit adapted to detect the temperature of the drying air and to provide at least one temperature signal to the control unit, wherein the control unit is adapted to control the heater unit to heat the drying air at a selected one of the two or more heating levels, wherein during the drying cycle the control unit is adapted to control the heater unit using a selected one of two or more heater control subroutines and by applying at least one temperature threshold set for determining the heating level to be applied by the heater unit in dependency of the at least one temperature signal from the temperature sensor unit, and wherein the control unit is adapted to select one of the two or more heater control subroutines in dependency of one or more of the following operation parameters:

a) the time or temporal progress of the laundry drying cycle, b) one or more operation parameters of or for the heater unit, c) an electrical or mechanical parameter of the drum motor, d) a temporal gradient of the drying air temperature during execution of the laundry drying cycle, e) an ambient temperature indicative for the temperature outside the apparatus cabinet or a temperature indicative of an apparatus component temperature.

f) a laundry parameter indicating the state or condition of the laundry received in the drum, and g) a user selection of one of two or more different drying programs input by the user via an input unit of the apparatus.

In all of the above and below embodiments, preferably, during the drying cycle the control unit is adapted to control the heater unit using a selected one of two or more heater control subroutines by applying the selected or determined one of the temperature threshold sets, wherein the control unit is adapted to select one of the two or more heater control subroutines in dependency of one or more of the following operation parameters:

a) the time or temporal progress of the laundry drying cycle, b) one or more operation parameters of or for the heater unit, c) an electrical or mechanical parameter of the drum motor, d) a temporal gradient of the drying air temperature during execution of the laundry drying cycle, e) an ambient temperature indicative for the temperature outside the apparatus cabinet or a temperature indicative of an apparatus component temperature.

f) a laundry parameter indicating the state or condition of the laundry received in the drum, and g) a user selection of one of two or more different drying programs input by the user via an input unit of the apparatus.

Generally, the selection of the heater control subroutine may be based on the same operation parameter(s) as the selection or determination of the temperature threshold(s) to be applied or may be based on totally different operation parameters or may be based on partially different operation parameters.

The operation parameter f) may be one or more of the following: the type of laundry, the starting humidity or targeted final humidity of the laundry, the humidity of the laundry, the laundry load, and the temperature of the laundry. Laundry load may refer to laundry volume and additionally or alternatively to laundry weight. The type, load, start or target humidity of the laundry may be determined based on a user selection or may be determined by the drying apparatus, i.e. by means of respective sensors of the apparatus.

Preferably, when a first heater control subroutine is executed by the control unit, the control unit is adapted to control the heater unit to change between a first and a second heating power level. When a second heater control subroutine is executed by the control unit, the control unit is adapted to control the heater unit to change between a first and a fourth or between a third and a fourth heating power level.

When the control unit changes the selected or determined temperature threshold set to be applied, it may concurrently change the heater control subroutine to be applied. Alternatively or additionally the control unit may change the selected or determined temperature threshold set independent or temporally independent of a change of the selected heater control subroutine. Preferably, the heater control subroutine is only changed if it was (previously) determined that another heater control subroutines has to be applied.

Preferably, the operation parameters a) to e) for selecting or determining the one of the two or more temperature threshold sets and/or the operation parameters a) to g) for selecting the one of the two or more heater control subroutines are in turn determined on the basis of one or more of the following parameters:

k) a drying program selector position;

l) a drying program options selected by a user;

m) the laundry type;

n) the laundry load;

o) the temperature of ambient where the drying apparatus is placed;

p) a temperature of the laundry drying apparatus;

q) the laundry weight;

r) the laundry humidity;

s) an electrical or mechanical parameter of a motor rotating the drum; and t) an inertia of the drum.

With respect to parameter t), the drum inertia, it is estimated from an estimation unit, preferably provided by the control unit of the laundry drying apparatus, by monitoring the torque values provided by a motor control unit for controlling the drum and motor operation and speed. The estimation for drum inertia and the drum acceleration are based on the input values for the motor torque from the motor control unit. The moment of inertia Je determined as a function of the torque values itself. Estimating the drum inertia is explained in detail in EP 2 107 151 A1 to which reference is made. In particular paragraphs 0019 to 0024 therein are included in the present description by reference and with the requirement that what is disclosed in EP 2 107 151 A1 for a washing machine is fully applicable here for the laundry drying apparatus.

According to a preferred embodiment, subsequent to a first period of applying a first temperature threshold set and/or a first heater control subroutine or subsequent to a second period of applying a second temperature threshold set and/or a second heater control subroutine, for determining or selecting a second or third time the temperature threshold set to be used for heater unit control and/or for determining a second or third heater control subroutine, the respective operation parameters are determined on the basis of one or more of the following parameters:

- the operation parameters k) to s) as applicable and as detected or determined in a first or second period of the drying cycle;
- the cycle time;
- the number (n_OFF) of the heater unit switching OFF or ON detected in a first or second period of the drying cycle, wherein switching ON and OFF of the heater unit in this embodiment comprises controlling the heater unit such that the heating power is increased or decreased, respectively;
- the time ($t_{ON_OFF}$) elapsed between the heater unit switching ON (OFF) and subsequent switching OFF (ON) detected in a first or second period of the drying cycle;
- the time ($t_{Start_OFF}$) elapsed from the first switching ON of the heater unit and the first switching OFF thereof in the first or second part of the drying cycle;
- the gradient of drying air temperature detected in a first or second part of the drying cycle;
- the rate of heating power supplied to drying air detected in a time slot during a first or second period of the drying cycle; and
- the rate of heating power supplied to drying air detected in a time slot between two subsequent operations (switching) of the heater unit during a first or second part of the drying cycle.

Preferably, the control unit is adapted to select or determine—after having changed within the running drying cycle from applying a first set of temperature threshold set to a second temperature threshold set—a next temperature threshold set on one or more of the following operation parameters:

one or more of the operation parameters a) to e), f) a laundry parameter indicating the state or condition of the laundry received in the drum, and g) a user selection of one of two or more different drying programs input by the user via an input unit of the apparatus.

According to a method of controlling the temperature during a drying cycle in a laundry drying apparatus, in particular in an apparatus according to any of the above embodiments, the apparatus comprises: a cabinet, a drum rotatably arranged within the cabinet for receiving laundry to be dried, a heater unit for heating the drying air, wherein the heater unit has two or more heating levels for heating the drying air at a selected one of the two or more heating levels, and a temperature sensor unit for detecting the temperature of the drying air.

Specifically the method comprises the steps of: selecting or determining one of two or more temperature threshold sets, determining the heating level to be applied by the heater unit (6) in dependency of the at least one selected or determined temperature threshold set, and operating the heater unit at the determined heating level.

The temperature thresholds of the temperature threshold sets are mutually different or are not identical, and the one of the two or more temperature threshold sets is/are selected or determined in dependency of one or more of the following operating parameters of the apparatus:

a) the time or temporal progress of the laundry drying cycle,
b) one or more operation parameters of or for the heater unit,
c) an electrical or mechanical parameter of a drum motor adapted to rotate the drum,
d) a temporal gradient of the drying air temperature during execution of the laundry drying cycle, and
e) an ambient temperature indicative for the temperature outside the apparatus cabinet or a temperature indicative of an apparatus component temperature.

As mentioned above, each one of the temperature threshold sets is used to control the heater power or temperature by comparing one or more or combined temperatures received from the temperature sensor unit to the at least two temperature thresholds given by each one of the temperature threshold sets.

Preferably the selecting or determining one of two or more temperature threshold sets is made permanently, repeatedly, periodically, in predefined intervals, and/or upon a change of one or more of the apparatus operation parameters (the 'groups' of parameters mentioned below). In an embodiment the conditions for changing the temperature threshold set changes at least upon at least one change of the threshold set. In an embodiment during the drying cycle the temperature threshold set is changed at least one, two or three times.

For the method and for the apparatus all embodiments and features are mutually applicable in any combination or sub-combination, i.e. any individual feature or combined features disclosed for the drying apparatus are also applicable for the method and vice versa.

BRIEF DESCRIPTION OF THE DRAWINGS

Reference is made in detail to preferred embodiments of the invention, examples of which are illustrated in the accompanying figures, which show.

The following figures are not drawn to scale and are provided for illustrative purposes.

DETAILED DESCRIPTION OF EXAMPLE EMBODIMENTS

Figure 1:
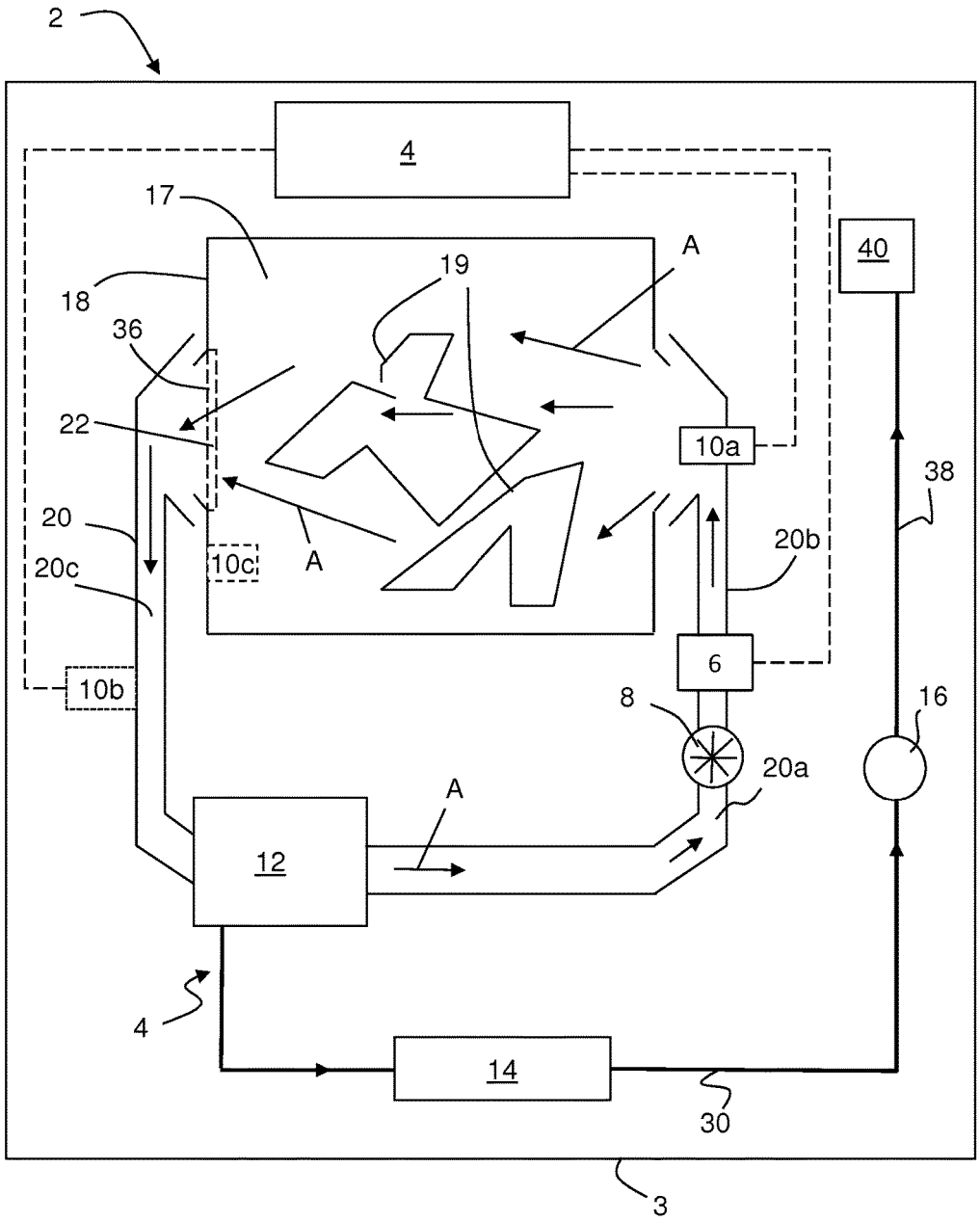
FIG. 1 a schematic view of a laundry dryer.

FIG. 1 shows schematically depicted a laundry dryer 2 comprising a housing 3 or cabinet enclosing below described exemplary components of the dryer 2. The process air or drying air flow A within the dryer 2 is guided through a laundry storing compartment 17 of the dryer 2, i.e. through a compartment for receiving articles to be treated, e.g. a drum 18. The articles to be treated are laundry 19, clothes, shoes or the like. The process air flow is indicated by arrows A in FIG. 1 and is driven by a process air blower 8. A process air channel 20 guides the process air flow A outside the drum 18 and comprises different sections, including the section forming a rear channel 20*a* in which the process air blower 8 is arranged. The air conveyed by blower 8 is guided upward in a rising channel 20*b* to the backside of the drum 18. A heater unit 6 is arranged downstream the blower 8 to heat the process air before it enters the drum 18. The air exiting the drum 18 through the drum outlet (which is the loading opening 36 of the drum 18) is filtered by a fluff filter 22 arranged close to the drum outlet in or at the channel 20. The optional fluff filter 22 is arranged in a front channel 20*c* forming another section of channel 20 which is arranged behind and adjacent the front cover of the dryer 2. A condensation unit or condenser 12 for dehumidifying the process air is arranged downstream the drum 18. The condensate formed at the condenser 12 is collected and guided to the condensate collector 14. For example an air-cooled condenser 12 may be provided.

The condensate collector 30 is connected via a drain conduit 30, a drain pump 16 and a drawer pipe 38 to an extractable condensate drawer 40. I.e. the collected condensate can be pumped from the collector 30 to the drawer 40 which is arranged at an upper portion of the dryer 2 from where it can be comfortably withdrawn and emptied by a user. The dryer 2 comprises a control unit 4 for controlling and monitoring the overall operation of the dryer 2. As shown in FIG. 1, the control unit 4 also controls the heater unit 6. Additionally, the control unit 4 is able to control other parts of the dryer 2.

For example the heater unit 6 may be an electrical resistivity heater unit which comprises at least two resistivity heater elements. In this case a first heating level with a first heating power is provided by powering a first one of the resistivity heater elements and a second heating level with a second heating power is provided by powering a second one of the resistivity heater elements and/or the first and second resistivity heater elements. As an example for a multi-level heater unit 6, the heater unit 6 may comprise two heater elements R1, R2 having different heating power, such that four heating levels may be achieved, namely 0 (zero=all heater elements switched-off), R1, R2, R1+R2.

At least one temperature sensor 10*a-c* is provided to detect the temperature of the process air A. As shown in the example of FIG. 1, a temperature sensor 10*a* is arranged at a drum inlet to detect the temperature of the air before or when entering the drum ($T_{DRY_IN}$). Additionally or alternatively temperature sensor(s) 10*b-c* may be arranged at different positions, e.g. at a drum outlet to detect the temperature of the air exiting the drum 18 (sensor 10*b*) or within the drum 18 (sensor 10*c*). Preferably the temperature sensor(s) 10*a-b* is arranged just upstream or downstream the drum 18.

The heater unit 6 is driven through control unit 4 by detecting the process air temperature and activating the heater unit 6—or at least a heater element—when the detected process air temperature drops below a minimum temperature threshold ($T_{MIN}$), and deactivating the heater unit 6—or at least a heater element—when the detected process air temperature gets higher than a maximum temperature threshold ($T_{MAX}$). Thus, a so-called Hysteresis-control is applied.

Hysteresis values for controlling process air temperature may be changed during a drying cycle. Such change may involve changing just one of the two hysteresis values ($T_{MIN}$/$T_{MAX}$) or both values.

Figure 2A:
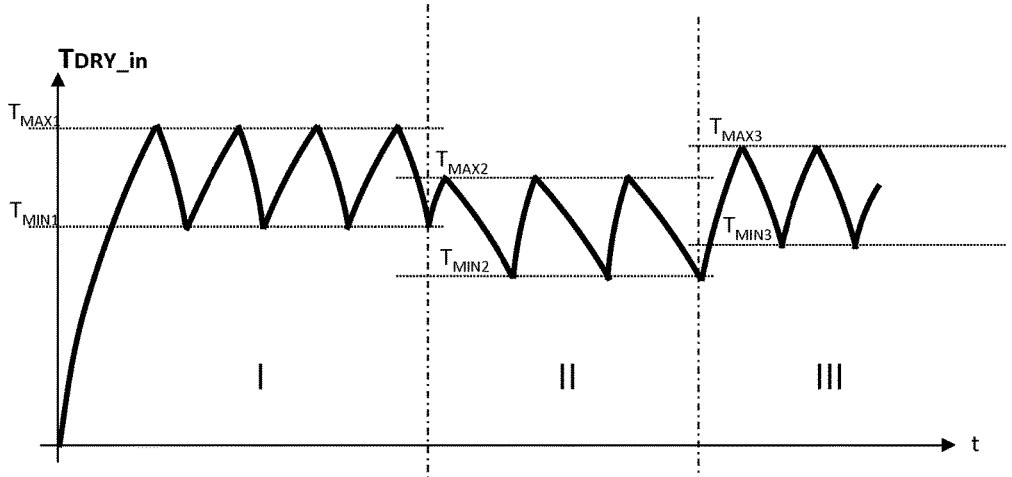
FIGS. 2*a-b* graphs illustrating a first embodiment of operating a laundry dryer an example of which is shown in FIG. 1, FIGS. 3*a-b* graphs illustrating a second embodiment of operating a laundry dryer an example of which is shown in FIG. 1, FIGS. 4*a-b* graphs illustrating a third embodiment of operating a laundry dryer an example of which is shown in FIG. 1, and FIGS. 5*a-c* graphs illustrating a fourth embodiment of operating a laundry dryer an example of which is shown in FIG. 1.
Figure 2B:
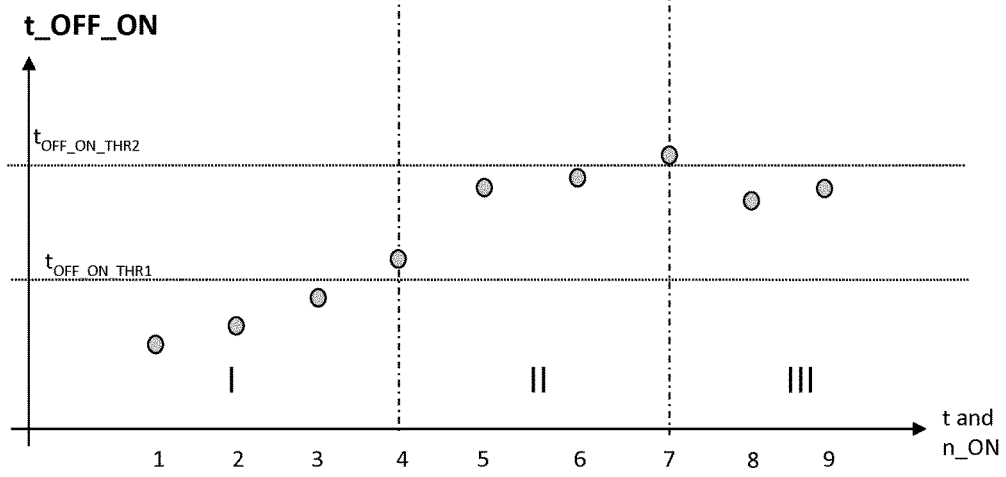

An operation parameter that determines a change of at least one of the process air temperature hysteresis thresholds so as to change the threshold set from a first set to a second set of thresholds, may be one or more of the following group I:

- cycle time;
- umber (n_OFF) of heating elements switching OFF or ON;
- time ($t_{OFF_ON}$) elapsed between heating elements switching OFF (ON) and subsequent switching ON (OFF)—compare FIGS. 2*a-b;*
- rate of heating power supplied to drying air over a drying cycle time slot, or between two subsequent operations (switching) of the heater unit 6;
- electrical or mechanical parameter of a motor rotating the drum (current, voltage, power, phase supplied to the motor, torque supplied by the motor); and/or
- gradient of air temperature over a drying cycle time slot.

One or more of the operation parameters is detected during a drying operation. When the detected value of the operation parameter reaches a predetermined threshold, the process air temperature hysteresis threshold set is changed.

When process air temperature hysteresis threshold(s) are changed, a 'heating power control logic' for supplying heating power to the drying air may change at the same time or afterwards. Such change is operated to adapt the operation of the heater unit 6 to the new thresholds while avoiding too frequent activations of the heating device or a too slow ramp for reaching the new temperature thresholds.

In particular, a change in the 'heating power control logic' may be operated even before the process air temperature hysteresis threshold(s) change, i.e. independently from the change of the change of hysteresis threshold changes. This provides the advantage of adapting the energy consumption to a desired amount or regulating the drying cycle time.

The 'heating power control logic' controlling the heater unit 6 for supplying heating power to process air can be changed among a set of 'heating power control logics' based on one or more of the following group II:

- a parameter of group I, and/or
- a parameter indicating laundry status/condition within the drum (humidity, weight, temperature);

'Heating power control logic' means the way of driving and regulating the heater unit 6 such that the heating power supplied to drying air by the heater unit 6 is comprised between a minimum and a maximum value ($T_{MIN}$, $T_{MAX}$). Such values can be selected between groups of values that the heater unit 6 can provide. For example the heater unit 6 as described above in form of an electric resistivity heater having two branches may be controlled using a first logic in which both branches are switched ON and OFF, or using a second logic in which a first branch is always ON and only the second branch is switched ON and OFF. The number of control logics available depends not only from the heating power amounts that the heater unit 6 can provide but also from the way in which such heating power amounts are supplied to drying air. The set, i.e. the number, of 'heating power control logics' selectable by a dryer control unit during a laundry drying cycle may be determined based on a parameter that may be selected among one or more of parameters indicated in Group III and IV below. For example, when a user selects a drying cycle, a specific group of heating power control logics may be assigned to that cycle by the control unit 4. The control unit 4 will change the heater unit 6 control from one control logic to another one based on comparison between the detected value of one or more operation parameters listed in Group II and specific thresholds assigned to the control unit 4. Assignment of such thresholds is described below.

It has to be noted that the change of at least one threshold of process air temperature hysteresis thresholds and the change of heating power control logic can be operated not only on the base of the same parameter or composition of parameters, but also based on different parameters or composition of parameters.

The threshold determined for the parameter, or group of parameters, causing a change of at least one of the process air temperature hysteresis thresholds may be the same, or not the same, as the threshold determined for the parameter, or group of parameters, causing a change of the 'heating power control logic'. In this way, the change of at least one of the process air temperature hysteresis thresholds and the change of the 'heating power control logic' does not necessarily happen at the same time even in case they are modified based on the same parameter.

A first set of process air temperature hysteresis thresholds and/or 'heating power control logics' to be used in a first part of a drying cycle may be determined based on one or more of the parameters indicated in following group III:

- drying program selector position;
- drying program options selected by a user;
- laundry type;
- laundry load;
- ambient temperature where the laundry drying apparatus is placed;
- temperature of laundry drying machine;
- laundry weight;
- laundry humidity; and
- electrical and/or mechanical parameter(s) of a motor rotating the drum.

A second or third set of process air temperature hysteresis thresholds and/or heating power control logics to be used in a second or third part of a drying cycle, subsequent to the first or second part of the same drying cycle, may be determined based on one or more of the following parameters indicated in following group IV:

- parameters of group III detected in a first or second part of the drying cycle;
- cycle time;
- number (n_OFF) of heating elements switching OFF or ON detected in a first or second part of the drying cycle;
- time ($t_{ON_OFF}$) elapsed between heating elements switching ON(OFF) and subsequent switching OFF(ON) detected in a first or second part of the drying cycle;
- time ($t_{Start_OFF}$) elapsed from the first switching ON of the heating elements and the first switching OFF thereof in the first or second part of the drying cycle.
- gradient of drying air temperature detected in a first or second part of the drying cycle; and
- rate of heating power supplied to drying air detected in a time slot during of a first or second part of the drying cycle, or between two subsequent operations (switching) of the heater unit 6 during a first or second part of the drying cycle.

The second process air temperature hysteresis thresholds set may be lower or higher than the first set.

For example, the third set may be lower than the first set but higher than the second set. In this way a too low threshold set change operated as first change may be compensated by means of a second change that will put the threshold set between the first set and the too low second set.

With the above described drying apparatus a drying cycle may be updated by means of a second threshold change, which determines whether the first change was appropriate or not in terms of activating/deactivating operations of the heater unit 6 (to reduce or minimize hardware stress), drying air temperature, drying speed/efficiency, energy consumption and overall drying time.

The following graphs relate to a laundry drying apparatus 2 as described above having a temperature sensor 10*a* for detecting drying air temperature at the drum inlet, and a heater unit in the form of an electrical resistivity heater 6 having at least two independently controllable heater elements or branches. The following FIGS. 2 to 5 show exemplary graphs to illustrate some of the above described embodiments. Further sensors and/or algorithm may be provided for detecting or calculating the parameter(s) causing the change of one or both thresholds of the drying air temperature.

The graph shown in FIG. 2*a* depicts the temperature of drying air entering the drum ($T_{DRY_IN}$) in dependency of elapsed time t of a drying cycle. For the same time span as shown in FIG. 2*a*, FIG. 2*b* depicts the time elapsed between switching OFF at least one branch of the heater unit 6 and switching ON at least one branch of the heater unit 6 ($t_{OFF_ON}$), wherein n_ON indicates the number of times the heater unit 6 or a branch thereof has been switched-on. In each graph two thresholds are indicated for each threshold set ($T_{MIN1\ldots3}/t_{MAX1\ldots3}$). Generally, the terms switching OFF and switching ON of the heater unit 6 includes the meaning of reducing to the next lower heating power level (OFF) and/or increasing to the next higher heating power level (ON).

As described above, the (selected) threshold set is changed during the drying cycle (periods I to III). As shown in FIG. 2*b*, during a first period I of the drying cycle a first threshold set $T_{MIN1}/T_{MAX1}$ is selected for controlling the heater unit 6, i.e. the heater unit 6 (or at least a branch thereof) is switched OFF when the maximum temperature threshold $T_{MAX1}$ is reached and switched ON when reaching the minimum temperature threshold $T_{MIN1}$.

As shown in FIG. 2*b*, when a minimum threshold value $t_{OFF_ON_THR1}$ between switching the heater unit 6 OFF and ON is reached or exceeded, a second threshold set $T_{MIN2}/T_{MAX2}$ is selected for controlling the heater unit 6 during a second period II of the drying cycle. The values of the second threshold set are lower than the values of the first threshold set. In particular, the second maximum threshold $T_{MAX2}$ is lower than the first maximum threshold $T_{MAX1}$ and the second minimum threshold $T_{MIN2}$ is lower than the first minimum threshold $T_{MIN1}$.

When a maximum threshold value $t_{OFF_ON_THR2}$ between switching the heater unit 6 OFF and ON is reached or exceeded, a third threshold set $T_{MIN3}/T_{MAX3}$ is selected for controlling the heater unit 6 during a third period III of the drying cycle. The minimum and maximum temperature values of the third threshold set are higher than the respective temperature values of the second threshold set.

This embodiment provides that the time or period between switching the heater unit 6 ON and OFF is maintained in a (time) frame which minimizes hardware stress and provides efficient heating.

Figure 3A:
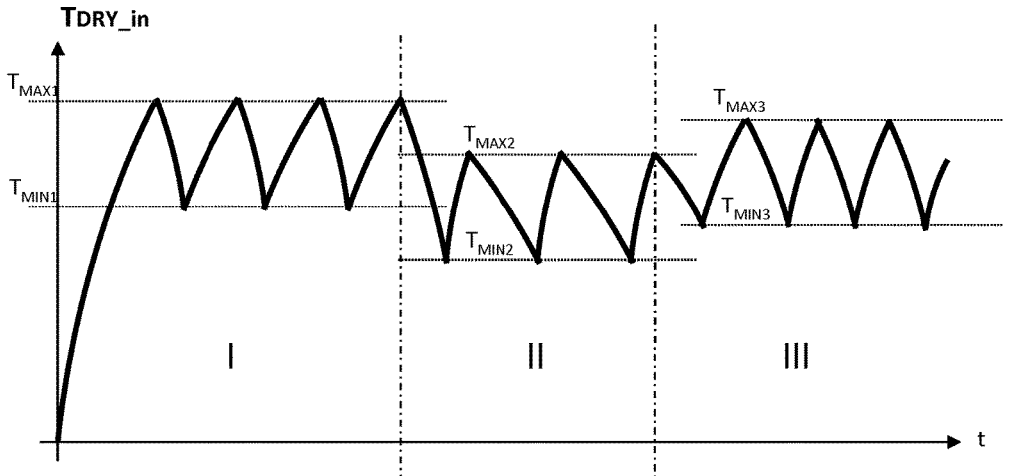
Figure 3B:
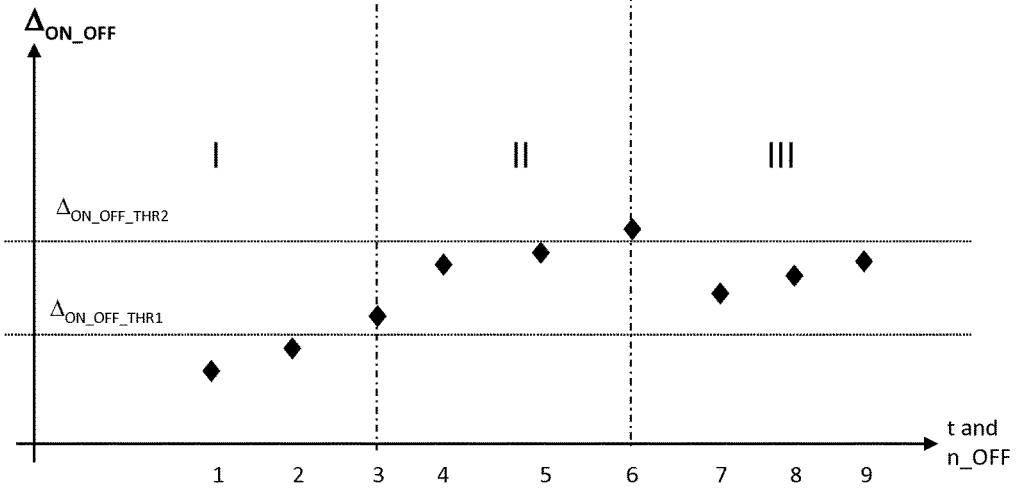

FIGS. 3*a* and 3*b* show graphs for illustrating a further embodiment where the respective temperature threshold sets $T_{MIN1 \ldots 3}/T_{MAX1 \ldots 3}$ are selected based on the temperature gradient $\Delta_{ON_OFF}$ in the time between switching ON of at least one branch of a heater unit 6 and subsequently switching OFF of at least one branch of the heater unit 6. As described above, FIG. 3*a* shows the course of the process air temperature $T_{DRY_IN}$ entering the drum 18 over time t. A threshold set $T_{MIN1 \ldots 3}/T_{MAX1 \ldots 3}$ with two threshold values is indicated for each drying cycle period I to III.

In this embodiment, the detected operation parameter on which the selection of the threshold values depends is the temperature gradient $\Delta_{ON_OFF}$. As shown in FIG. 3*b*, when a minimum temperature gradient $\Delta_{ON_OFF_THR1}$ is reached or exceeded, a second set of temperature thresholds $T_{MIN2}/T_{MAX2}$ is selected for controlling the operation of the heater unit 6. Similar to above FIGS. 2*a-b*, the minimum and maximum values of the second threshold set $T_{MIN2}/T_{MAX2}$ are lower than the respective values of the first threshold set $T_{MIN1}/T_{MAX1}$.

When a maximum temperature gradient $\Delta_{ON_OFF_THR2}$ is reached or exceeded, a third set of temperature thresholds $T_{MIN3}/T_{MAX3}$ is selected for controlling the operation of the heater unit 6. The minimum and maximum values of the third threshold set $T_{MIN3}/T_{MAX3}$ are lower than the respective values of the first threshold set $T_{MIN1}/T_{MAX1}$ and higher than the respective values of the second threshold set $T_{MIN2}/T_{MAX2}$.

Figure 4A:
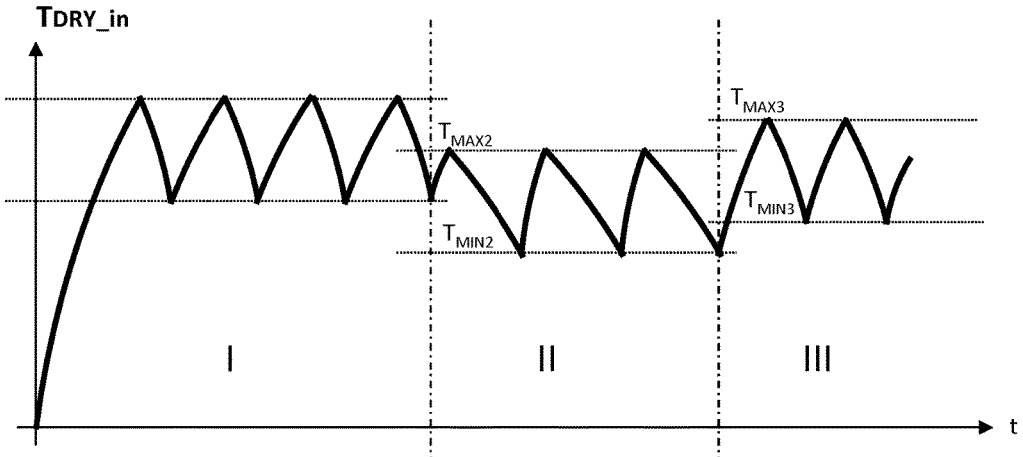
Figure 4B:
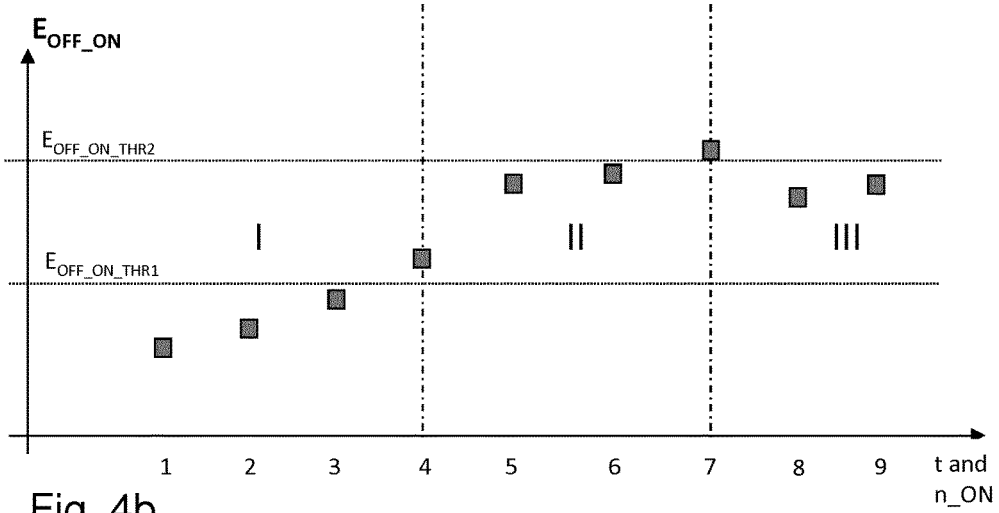

FIGS. 4*a* and 4*b* show graphs for illustrating a further embodiment where the respective threshold sets are selected based on the power $E_{OFF_ON}$ [Watt/h] supplied to the heater unit 6 between switching OFF of at least one branch of the heater unit 6 and subsequently switching ON at least one branch of the heater unit 6. In this graph it is supposed that at least one branch of the heater unit 6 remains ON, i.e. active, when a switching OFF action is operated on the heater unit 6. As described above, FIG. 4*a* shows the course of the process air temperature $T_{DRY_IN}$ entering the drum 18 over time t. A threshold set $T_{MIN1 \ldots 3}/T_{MAX1 \ldots 3}$ with two threshold values is indicated for each drying cycle period I to III.

In this embodiment, the detected operation parameter on which the selection of the threshold values depends is the power $E_{OFF_ON}$. As shown in FIG. 4*b*, when a minimum power $E_{OFF_ON_THR1}$ is reached or exceeded, a second set of temperature thresholds $T_{MIN2}/T_{MAX2}$ is selected for controlling the operation of the heater unit 6. The minimum and maximum values of the second threshold set $T_{MIN2}/T_{MAX2}$ are lower than the respective values of the first threshold set $T_{MIN1}/T_{MAX1}$.

When a maximum power $E_{OFF_ON_THR2}$ is reached or exceeded, a third set of temperature thresholds $T_{MIN3}/T_{MAX3}$ is selected for controlling the operation of the heater unit 6. The minimum and maximum value of the third threshold set $T_{MIN3}/T_{MAX3}$ is lower than the respective value of the first threshold set $T_{MIN1}/T_{MAX1}$ and higher than the respective value of the second threshold set $T_{MIN2}/T_{MAX2}$.

This embodiment prevents that a first branch of the heater unit 6—which remains switched ON while the second branch is switched OFF—is overstressed. Thereby the service life of the heater unit 6 is increased. Additionally to changing the applied temperature threshold set, above described heating power control logic for the heater unit 6 may be changed in all above and below described embodiments to provide a more energy efficient operation of the heater unit 6.

Figure 5A:
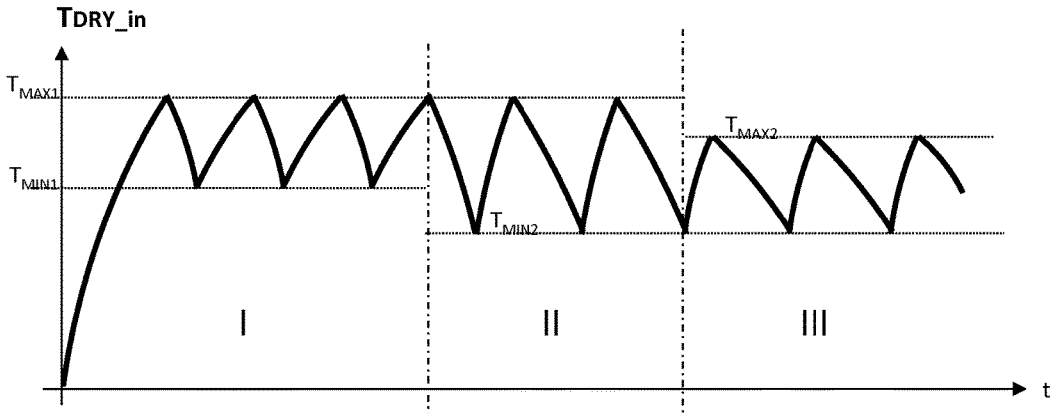
Figure 5B:
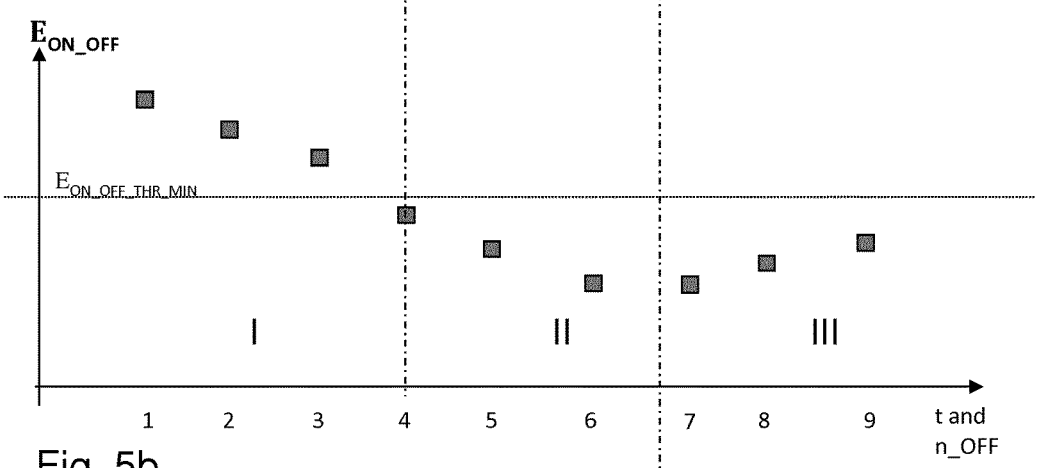
Figure 5C:
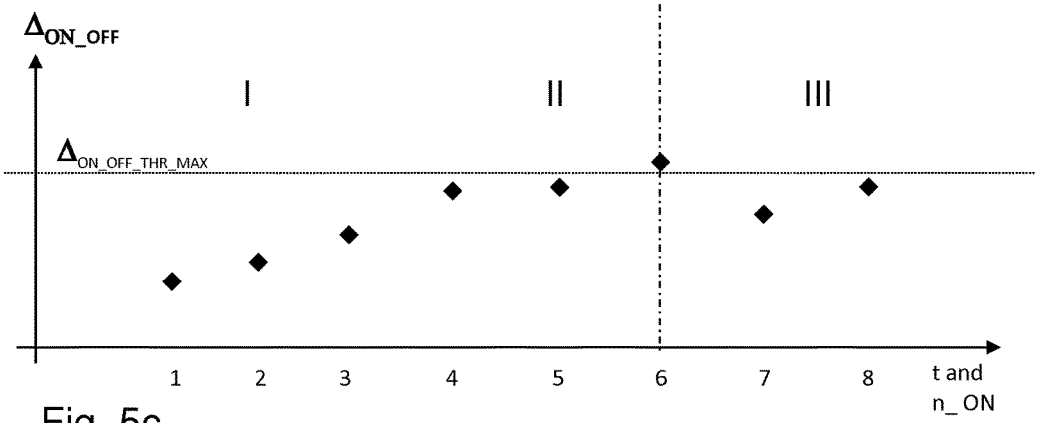

FIGS. 5*a*, 5*b* and 5*c* show graphs for illustrating a further embodiment where respective threshold sets are selected based on power $E_{OFF_ON}$ and the temperature gradient $\Delta_{ON_OFF}$. Power $E_{OFF_ON}$ and temperature gradient $\Delta_{ON_OFF}$ are defined as described above.

In contrast to above embodiments of FIGS. 2 to 4, FIGS. 5*a-c* illustrate an embodiment where each temperature threshold ($T_{MAX}$ and $T_{MIN}$) of the drying air temperature $T_{DRY_IN}$ can be changed independently from one another by using two different operation parameters (here: $E_{ON_OFF}$ and $\Delta_{ON_OFF}$ as an example). A predetermined threshold ($T_{MIN}$ or $T_{MAX}$) is assigned to each of said operation parameters to determine when the process air temperature threshold to which the respective operation parameter is linked to has to be changed. In this example, reaching or exceeding a minimum power $E_{ON_OFF_THR_MIN}$ (FIG. 5*b*) causes a change (here: reduction) of the lower temperature threshold value from $T_{MIN1}$ to $T_{MIN2}$, while the upper temperature threshold $T_{MAX1}$ is maintained (period II). Reaching or exceeding a maximum temperature gradient $\Delta_{ON_OFF_THR_MAX}$ (FIG. 5*c*) causes a change (here: reduction) of the upper temperature threshold $T_{MAX1}$ to $T_{MAX2}$, while the lower temperature threshold $T_{MIN2}$ is maintained (period III).

REFERENCE NUMERAL LIST

2 laundry dryer
3 housing/cabinet
4 control unit
6 heater unit
8 blower
10*a-c* temperature sensor
12 condenser/condensation unit
14 condensate collector
16 drain pump
17 laundry storing compartment
18 drum
19 laundry
20 process air channel
20*a* rear channel
20*b* rising channel
20*c* front channel
22 fluff filter element
30 drain conduit
36 loading opening
38 drawer pipe
40 condensate drawer
A process air flow

The invention claimed is:

1. Laundry drying apparatus, in particular dryer or washing machine having drying function, comprising:

a cabinet, a control unit adapted to control a laundry drying cycle according to at least one drying program, a drum rotatably arranged within the cabinet for receiving laundry to be dried, a drying air channel adapted at least to guide drying air into the drum, a heater unit arranged at or in the drying air channel and being adapted to heat the drying air, wherein the heater unit has two or more heating levels, and a temperature sensor unit adapted to detect the temperature of the drying air and to provide at least one temperature signal to the control unit, wherein the control unit is adapted to control the heater unit to heat the drying air at a selected one of the two or more heating levels, wherein the control unit is adapted to select or determine and apply during the drying cycle one of two or more temperature threshold sets ($T_{MIN1 \ldots 3}$, $T_{MAX1 \ldots 3}$), wherein the two or more temperature threshold sets are used by the control unit for determining the heating level to be applied by the heater unit in dependency of the at least one temperature signal from the temperature sensor unit, wherein the control unit is adapted to select or determine one of the two or more temperature threshold sets ($T_{MIN1 \ldots 3}/T_{MAX1 \ldots 3}$) in dependency of one or more operating parameters ($t_{OFF_ON}$, $\Delta_{ON_OFF}$, $E_{OFF_ON}$) of the apparatus, and wherein the temperature thresholds of the temperature threshold sets ($T_{MIN1 \ldots 3}/T_{MAX1 \ldots 3}$) are mutually different or are not identical, wherein during execution of the laundry drying cycle the control unit is adapted to select or determine one of the two or more temperature threshold sets ($T_{MIN1 \ldots 3}/T_{MAX1 \ldots 3}$) in dependency of one or more of the following operation parameters:

a) the time or temporal progress of the laundry drying cycle, b) one or more operation parameters of or for the heater unit, c) an electrical or mechanical parameter of the drum motor, d) a temporal gradient of the drying air temperature during execution of the laundry drying cycle, and e) an ambient temperature indicative for the temperature outside the apparatus cabinet or a temperature indicative of an apparatus component temperature.

2. Laundry drying apparatus according to claim 1, wherein the b) one or more operation parameters of the heater unit include one or more of:

the number of times (n_OFF) the control unit reduces the heating level of the heater unit or the number of times (n_ON) the control unit increases the heating level of the heater unit or the number of periods in which the control unit controls a reduction and increase of the heating level of the heater unit, the time or duration of a period ($t_{ON_OFF}$) in which the control unit increases the heating level of the heater unit to the subsequent reduction of the heating level, the time or duration of a period ($t_{OFF_ON}$) in which the control unit decreases the heating level of the heater unit to the subsequent increase of the heating level, the time or duration of a period in which the control unit controls a reduction and the subsequent increase of the heating level of the heater unit, the heating energy supplied to the heater unit during a period in which the control unit controls a reduction and the subsequent increase of the heating level of the heater unit, and the power supplied to the heater unit averaged over predetermined time periods.

3. Laundry drying apparatus according to claim 1, wherein the c) electrical or mechanical parameter of the drum motor is one or more of:

the motor current, the phase voltage, the consumed motor power, the phase of the voltage applied to the motor, and the torque generated by the motor.

4. Laundry drying apparatus according to claim 1, wherein the temporal gradient of the drying air temperature is determined using the one or more signals of the temperature sensor unit.

5. Laundry drying apparatus according to claim 1, wherein the heater unit has at least three heating levels comprising a non-heating level and a first and a second heating level, wherein the heating power at the first and second heating level is above 0 W and wherein the heating power of the second heating level is higher than the heating power of the first heating level, or wherein the heater unit is an electrical resistivity heater unit having at least two resistivity heater elements wherein a first heating level with a first heating power is provided by powering a first one of the resistivity heater elements and a second heating level with a second heating power is provided by powering a second one of the resistivity heater elements or the first and second resistivity heater elements.

6. Laundry drying apparatus according to claim 1, wherein the laundry drying apparatus is a condensate-type drying apparatus having a closed drying air loop comprising the drying air channel and the drum as a portion of the drying air loop, and wherein a condensation unit is arranged in the drying air channel upstream the heater unit.

7. Laundry drying apparatus according to claim 1, wherein for controlling the heater unit the temperature sensor unit comprises at least one temperature sensor (10*a-c*) arranged to detect the drying air temperature at one or more of the following positions:

downstream the heater unit and upstream the drum air inlet, downstream the drum air outlet, within a tub surrounding the drum, and at the drum.

8. Laundry drying apparatus according to claim 1, wherein the control unit determining or selecting of the one of the two or more temperature threshold sets ($T_{MIN1 \ldots 3}/T_{MAX1 \ldots 3}$) in dependency of one or more operating parameters of the apparatus comprises:

a storing element of the control unit stores at least two different predetermined temperature threshold sets ($T_{MIN1 \ldots 3}/T_{MAX1 \ldots 3}$) and the control unit is adapted to select one of these predetermined temperature threshold sets ($T_{MIN1 \ldots 3}/T_{MAX1 \ldots 3}$) in dependency of the one or more operating parameters, a storing element of the control unit stores at least three different predetermined temperature thresholds and, in dependency of the one or more operating parameters, the control unit is adapted to select one of these predetermined temperature thresholds as the first lower temperature threshold ($T_{MIN1 \ldots 3}$) and one as the second higher temperature threshold ($T_{MAX1 \ldots 3}$), or the control unit is adapted to determine one of the two or more temperature threshold sets ($T_{MIN1 \ldots 3}/T_{MAX1 \ldots 3}$) by calculating at least one of the temperature thresholds for the next predetermined temperature threshold set to be applied on the basis of the one or more operating parameters.

9. Laundry drying apparatus according to claim 1, wherein each one of the temperature threshold set ($T_{MIN1 \ldots 3}/T_{MAX1 \ldots 3}$) comprises a first higher temperature threshold ($T_{MAX1 \ldots 3}$) used by the control unit for determining a drying air temperature state at which the heating power of the heater unit has to be set to a lower heating power, and a second lower temperature threshold ($T_{MIN1 \ldots 3}$) used by the control unit for determining a drying air temperature state at which the heating power of the heater unit has to be set to a higher heating power.

10. Laundry drying apparatus according to claim 1, wherein during execution of the laundry drying cycle the control unit is adapted to select the one of the two or more temperature threshold sets ($T_{MIN1 \ldots 3}/T_{MAX1 \ldots 3}$) independent of a detected laundry humidity or a current state of the laundry.

11. Laundry drying apparatus according to claim 1, wherein during the drying cycle the control unit is adapted to control the heater unit using a selected one of two or more heater control subroutines by applying the selected or determined one of the temperature threshold sets ($T_{MIN1 \ldots 3}/T_{MAX1 \ldots 3}$), and wherein the control unit is adapted to select one of the two or more heater control subroutines in dependency of one or more of the following operation parameters:

a) the time or temporal progress of the laundry drying cycle, b) one or more operation parameters of or for the heater unit, c) an electrical or mechanical parameter of the drum motor, d) a temporal gradient of the drying air temperature during execution of the laundry drying cycle, e) an ambient temperature indicative for the temperature outside the apparatus cabinet or a temperature indicative of an apparatus component temperature, f) a laundry parameter indicating the state or condition of the laundry received in the drum, and g) a user selection of one of two or more different drying programs input by the user via an input unit of the apparatus.

12. Laundry drying apparatus according to claim 11, wherein the f) laundry parameter is one or more of the following:

the type of laundry, the starting humidity or targeted final humidity of the laundry, the humidity of the laundry, the laundry load, and the temperature of the laundry.

13. Laundry drying apparatus according to claim 11, wherein when a first heater control subroutine is executed by the control unit, the control unit is adapted to control the heater unit to change between a first and a second heating power level, and when a second heater control subroutine is executed by the control unit, the control unit is adapted to control the heater unit to change between a first and a fourth or between a third and a fourth heating power level.

14. Laundry drying apparatus according to claim 11, wherein, when the control unit changes the selected or determined temperature threshold set to be applied, it concurrently changes the heater control subroutine to be applied, or wherein the control unit changes the selected or determined temperature threshold set independent or temporally independent of a change of the selected heater control subroutine.

15. Laundry drying apparatus according to claim 1, wherein the operation parameters a) to e) for selecting or determining the one of the two or more temperature threshold sets ($T_{MIN1 \ldots 3}/T_{MAX1 \ldots 3}$) or the operation parameters a) to g) of claim 11 for selecting the one of the two or more heater control subroutines are in turn determined on the basis of one or more of the following parameters:

k) a drying program selector position;

l) a drying program options selected by a user;

m) the laundry type;

n) the laundry load;

o) the temperature of ambient where the drying apparatus is placed;

p) a temperature of the laundry drying apparatus;

q) the laundry weight;

r) the laundry humidity;

s) an electrical or mechanical parameter of a motor rotating the drum; and t) the drum inertia.

16. Laundry drying apparatus according to claim 1, wherein, subsequent to a first period of applying a first temperature threshold set ($T_{MIN1}/T_{MAX1}$) and/or a first heater control subroutine or subsequent to a second period of applying a second temperature threshold set ($T_{MIN2}/T_{MAX2}$) and/or a second heater control subroutine, for determining or selecting a second or third time the temperature threshold set ($T_{MIN3}/T_{MAX3}$) to be used for heater unit control and/or for determining a second or third heater control subroutine, the respective operation parameters are determined on the basis of one or more of the following parameters:

the cycle time;

the number (n_OFF) of the heater unit switching OFF or ON detected in a first or second period of the drying cycle;

the time ($t_{ON_OFF}$) elapsed between the heater unit switching ON(OFF) and subsequent switching OFF (ON) detected in a first or second period of the drying cycle;

the time ($t_{Start_OFF}$) elapsed from the first switching ON of the heater unit and the first switching OFF thereof in the first or second part of the drying cycle;

the gradient of drying air temperature detected in a first or second part of the drying cycle;

the rate of heating power supplied to drying air detected in a time slot during a first or second period of the drying cycle;

the rate of heating power supplied to drying air detected in a time slot between two subsequent operations (switching) of the heater unit during a first or second part of the drying cycle; and when being dependent on claim 15, the operation parameters k) to t) as applicable and as detected or determined in a first or second period of the drying cycle.

17. Laundry drying apparatus according to claim 1, wherein the control unit is adapted to select or determine, after having changed within the running drying cycle from applying a first temperature threshold set to a second temperature threshold set, a next temperature threshold set on one or more of the following operation parameters:

one or more of the operation parameters a) to e), f) a laundry parameter indicating the state or condition of the laundry received in the drum, and g) a user selection of one of two or more different drying programs input by the user via an input unit of the apparatus.

18. Method of controlling the temperature during a drying cycle in a laundry drying apparatus, in particular in an apparatus according to claim 1, in a dryer or a washing machine having drying function, the apparatus comprising:

a cabinet, a drum rotatably arranged within the cabinet for receiving laundry to be dried, a heater unit for heating the drying air, wherein the heater unit has two or more heating levels for heating the drying air at a selected one of the two or more heating levels, and a temperature sensor unit for detecting the temperature of the drying air, wherein the method comprises the steps of:

selecting or determining one of two or more temperature threshold sets ($T_{MIN1 \ldots 3}$, $T_{MAX1 \ldots 3}$), determining the heating level to be applied by the heater unit in dependency of the at least one selected or determined temperature threshold set, and operating the heater unit at the determined heating level;

wherein the temperature thresholds of the temperature threshold sets ($T_{MIN1 \ldots 3}/T_{MAX1 \ldots 3}$) are mutually different or are not identical, and wherein the one of the two or more temperature threshold sets ($T_{MIN1 \ldots 3}/T_{MAX1 \ldots 3}$) is selected or determined in dependency of one or more of the following operating parameters ($t_{OFF_ON}$, $\Delta_{ON_OFF}$, $E_{OFF_ON}$) of the apparatus:

a) the time or temporal progress of the laundry drying cycle, b) one or more operation parameters of or for the heater unit, c) an electrical or mechanical parameter of a drum motor adapted to rotate the drum, d) a temporal gradient of the drying air temperature during execution of the laundry drying cycle, and e) an ambient temperature indicative for the temperature outside the apparatus cabinet or a temperature indicative of an apparatus component temperature.

19. Method of claim 18, wherein the selecting or determining one of two or more temperature threshold sets is made permanently, repeatedly, periodically, in predefined intervals, or upon a change of one or more of the apparatus operation parameters.

* * * * *